US008256856B2

(12) United States Patent
Yamashita

(10) Patent No.: US 8,256,856 B2
(45) Date of Patent: Sep. 4, 2012

(54) LIQUID DROPLET JETTING APPARATUS

(75) Inventor: Toru Yamashita, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 439 days.

(21) Appl. No.: 12/563,740

(22) Filed: Sep. 21, 2009

(65) Prior Publication Data

US 2010/0079519 A1 Apr. 1, 2010

(30) Foreign Application Priority Data

Sep. 30, 2008 (JP) ..... 2008-252058

(51) Int. Cl.
*B41J 29/38* (2006.01)

(52) U.S. Cl. ..... 347/10; 347/5; 347/6; 347/9; 347/11

(58) Field of Classification Search ..... 347/10, 347/11

See application file for complete search history.

(56) References Cited

U.S. PATENT DOCUMENTS

| | | | | |
|---|---|---|---|---|
| 5,404,229 | A | 4/1995 | Ono et al. | |
| 5,457,488 | A | 10/1995 | Nakamura et al. | |
| 5,696,950 | A | 12/1997 | Ichinose et al. | |
| 6,290,315 | B1 * | 9/2001 | Sayama | 347/10 |
| 6,354,686 | B1 * | 3/2002 | Tanaka et al. | 347/11 |
| 6,357,846 | B1 * | 3/2002 | Kitahara | 347/10 |
| 6,371,587 | B1 * | 4/2002 | Chang | 347/11 |
| 6,494,556 | B1 * | 12/2002 | Sayama et al. | 347/11 |
| 6,726,299 | B2 * | 4/2004 | Takahashi et al. | 347/11 |
| 2002/0018083 | A1 * | 2/2002 | Sayama | 347/5 |
| 2005/0116975 | A1 * | 6/2005 | Kasai | 347/10 |
| 2005/0270347 | A1 | 12/2005 | Yamamoto | |
| 2006/0077404 | A1 | 4/2006 | Usui | |
| 2006/0139394 | A1 | 6/2006 | Wada | |
| 2007/0057985 | A1 | 3/2007 | Saito et al. | |
| 2007/0085868 | A1 * | 4/2007 | Nakayama | 347/11 |
| 2007/0146403 | A1 * | 6/2007 | Sayama et al. | 347/10 |

FOREIGN PATENT DOCUMENTS

| | | |
|---|---|---|
| JP | 3006171 | 1/1991 |
| JP | 3-208656 | 9/1991 |
| JP | 7-61033 | 3/1995 |
| JP | 7162404 | 6/1995 |
| JP | 7-248844 | 9/1995 |
| JP | 7-323538 | 12/1995 |
| JP | 10269040 | 10/1998 |
| JP | 11-221913 | 8/1999 |

(Continued)

*Primary Examiner* — Ryan Lepisto
(74) *Attorney, Agent, or Firm* — Frommer Lawrence & Haug LLP

(57) ABSTRACT

A liquid droplet jetting apparatus includes a nozzle which jet the liquid droplets in a plurality of types of jetting modes; a liquid droplet jetting head which has the nozzles; a signal generating section which generates a plurality of types of jetting signals, each of which is formed of bit data, has predetermined bits not less than three bits, and corresponds to one of the plurality of types of jetting modes; and a signal supply section which outputs serially the bit data forming one of the jetting signals to the liquid droplet jetting head at each of jetting timings of the nozzle. The jetting signals are set such that the jetting signals corresponding to the jetting modes respectively are subjected to binary switching of the bit data at frequencies decreasing proportional to usage frequencies of the jetting modes when the bit data are outputted serially from the signal supply section.

6 Claims, 10 Drawing Sheets

| JETTING MODE | WAVEFORM SELECTION DATA | | |
|---|---|---|---|
| | THIRD DIGIT | SECOND DIGIT | FIRST DIGIT |
| NON-JETTING | 0 | 0 | 0 |
| S1 (SMALL DROPLETS 1) | 0 | 1 | 1 |
| S2 (SMALL DROPLETS 2) | 1 | 1 | 0 |
| M (MEDIUM DROPLETS) | 1 | 0 | 0 |
| L (LARGE DROPLETS) | 0 | 0 | 1 |
| LL (EXTREMELY LARGE DROPLETS) | 0 | 1 | 0 |

FOREIGN PATENT DOCUMENTS

| | | |
|---|---|---|
| JP | 2000-108324 | 4/2000 |
| JP | 2003-237051 | 8/2003 |
| JP | 2004-90262 | 3/2004 |
| JP | 2005-022404 | 1/2005 |
| JP | 2005-342992 | 12/2005 |
| JP | 2006-123524 | 5/2006 |
| JP | 2006-187872 | 7/2006 |
| JP | 2007-044878 | 2/2007 |
| JP | 2007-176065 | 7/2007 |
| JP | 2007-196448 | 8/2007 |
| JP | 2008-191792 | 8/2008 |

* cited by examiner

Fig. 8

| JETTING MODE | WAVEFORM SELECTION DATA | | |
|---|---|---|---|
| | THIRD DIGIT | SECOND DIGIT | FIRST DIGIT |
| NON-JETTING | 0 | 0 | 0 |
| S1 (SMALL DROPLETS 1) | 0 | 1 | 1 |
| S2 (SMALL DROPLETS 2) | 1 | 1 | 0 |
| M (MEDIUM DROPLETS) | 1 | 0 | 0 |
| L (LARGE DROPLETS) | 0 | 0 | 1 |
| LL (EXTREMELY LARGE DROPLETS) | 0 | 1 | 0 |

Fig. 10

| JETTING MODE | WAVEFORM SELECTION DATA | | | |
|---|---|---|---|---|
| | FOURTH DIGIT | THIRD DIGIT | SECOND DIGIT | FIRST DIGIT |
| NO. 1 (HIGH FREQUENCY) | 0 | 0 | 0 | 0 |
| NO. 2 | 0 | 1 | 1 | 1 |
| NO. 3 | 1 | 0 | 0 | 0 |
| NO. 4 | 1 | 1 | 0 | 0 |
| NO. 5 | 1 | 1 | 1 | 0 |
| NO. 6 (LOW FREQUENCY) | 0 | 1 | 1 | 0 |

LIQUID DROPLET JETTING APPARATUS

CROSS REFERENCE TO RELATED APPLICATION

The present application claims priority from Japanese Patent Application No. 2008-252058, filed on Sep. 30, 2008, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

A liquid droplet jetting apparatus, which is structured such that a control circuit board is provided at a position away from a liquid droplet jetting head which jets liquid droplets, and a signal for jetting the liquid droplets is transmitted from the control circuit board to the liquid droplet jetting head via a wire formed on a flexible wiring board, has hitherto been known.

In the liquid droplet jetting apparatus having a structure as described above, when the signal is transmitted from the control circuit board to the liquid droplet jetting head via the wiring board, a noise is radiated from each wire of the wiring board, to a surrounding area. This radiated noise has an effect on peripheral equipment, and also becomes a cause of malfunction of the apparatus. Therefore, a liquid droplet jetting apparatus having the following structure has been proposed in order to reduce such radiated noise.

For instance, a liquid droplet jetting apparatus disclosed in Japanese Patent Application Laid-open No. 2007-196448 includes a head which jets liquid droplets, a head control section which controls the head, and a drive signal generating section which generates a drive pulse to be applied to the head. Pixel data of two bits (four gradations namely, without dot, small dot, medium dot, and large dot) which is related to dots to be formed on a paper is inputted to the head control section from an ASIC upon being synchronized with a clock signal, via the wiring board. Moreover, based on the inputted pixel data, a desired pixel (dot) is formed by applying a predetermined interval portion corresponding to the pixel data, among drive pulses generated in the drive pulse generating section, to a piezoelectric element (liquid droplet jetting portion). The drive pulse generated in the drive pulse generating section is also outputted to the head control section via the wiring board. When there is no jetting of the liquid droplets from the head, the drive signal generating section outputs a constant voltage instead of the drive pulse to the head control section to reduce the noise radiated from the wiring board.

However, even at the time of transmitting the pixel data, which is formed of bit data of a predetermined number of digits related to a dot to be formed on the paper, from the ASIC to the head control section via the wiring board, the noise is radiated to the surrounding from the wires of the wiring board. More concretely, when the bit data forming the pixel data is transferred serially and continuously from the ASIC to the head control section, if there occurs a switching of "0" and "1" between (in) the bit data, due to a change in a signal level, the current flows instantaneously. At this time, the noise is radiated from the wires.

Moreover, when gradation is increased for an image formation of higher quality, the number of bits forming one pixel data increases (for example, becomes 3 bits or more), and the total number of bit data to be transmitted by the wiring board for one jetting timing increases. For transferring the increased bit data in a short time by increasing a data transfer speed, it is necessary to increase a clock frequency. However, with the increase in the clock frequency, the noise radiated from the wires at the time of data transfer tends to increase.

The abovementioned content will be described below more concretely. It is possible to express an electric field strength Ec (in other words, strength of the radiation noise) at a predetermined position around the wire at a distance d from the wire by the following expression (1).

$$Ec=0.628\times10^{-6}\times i[\mathrm{A}]\times f[\mathrm{Hz}]\times L[\mathrm{m}]\times(K\times1)/d[\mathrm{m}] \quad (1)$$

where, i is a magnitude of the electric current, and is proportional to the number of switching of a bit value ("0" and "1"). Moreover, f is a frequency of a transfer clock, L is a length of the wire, and K is a constant. From the expression (1), it is evident that as the switching frequency (the number of switching) (electric current i) of the bit value and the clock frequency f increases, the magnitude (strength) of the electric field increases. In this manner, when the clock frequency is increased (made higher) from increasing the transfer speed, an effect of the radiation noise generated from the wires due to the transfer of the bit data cannot be neglected. It is desirable to reduce the radiation noise generated by such factor.

SUMMARY OF THE INVENTION

An object of the present invention is to reduce, as much as possible, a noise radiated from wires, when a signal corresponding to a jetting mode of liquid droplet jetting and being formed by bit data of a predetermined number of digits not less than 3 is serially outputted to a liquid droplet jetting head.

According to a first aspect of the present invention, there is provided a liquid droplet jetting apparatus which jets liquid droplets, including a nozzle which jet the liquid droplets in a plurality of types of jetting modes; a liquid droplet jetting head which has the nozzles; a signal generating section which generates a plurality of types of jetting signals, each of which is formed of bit data, has predetermined bits not less than three bits, and corresponds to one of the plurality of types of jetting modes; and a signal supply section which outputs serially the bit data forming one of the jetting signals to the liquid droplet jetting head at each of jetting timings of the nozzle, and the jetting signals are set such that the jetting signals corresponding to the jetting modes respectively are subjected to binary switching of the bit data at frequencies decreasing proportional to usage frequencies of the jetting modes when the bit data are outputted serially from the signal supply section to the liquid droplet jetting head.

The signal generating section generates the plurality of types of jetting signals formed of bit data of a predetermined number of bits not less than 3. This plurality of types of jetting signals correspond to the plurality of types of jetting modes respectively, of the nozzle, and are signals which indicate a jetting mode at a predetermined jetting timing of the nozzle. The plurality of jetting modes includes jetting modes in which liquid droplets of different conditions such as a volume of liquid droplets and a type of liquid droplets are jetted respectively, and a jetting mode in which the liquid droplets are not jetted at all. Moreover, the signal supply section outputs serially the bit data of a predetermined number of digits forming the jetting signal corresponding to the jetting mode at each jetting timing of the nozzle to the liquid droplet jetting head.

Incidentally, in a case in which the bit data of the plurality of jetting signals are outputted serially from the signal supply section, when the binary (0 or 1) switching between the adjacent bits occurs frequently, the radiation noise from a wire which transmits the jetting signal becomes large, and the increased radiation noise becomes a cause of a malfunction etc. Here, in the jetting modes of plurality of types, when there is a difference in a usage frequency of the jetting modes, in a case in which the jetting signal corresponding to a jetting mode having a high usage frequency is outputted, it is desirable that the radiation noise in particular, is reduced. Therefore, in the present invention, the jetting signals are set such that the jetting signals corresponding to the jetting modes respectively are subjected to binary switching of the bit data at frequencies decreasing proportional to usage frequencies of the jetting modes when the bit data are outputted serially from the signal supply section to the liquid droplet jetting head.

Consequently, according to the case in which the jetting signal corresponding to the jetting mode having high usage frequency is outputted, the radiation noise is reduced effectively.

BRIEF DESCRIPTION OF THE DRAWINGS

FIG. 8 is a diagram showing a relationship of jetting mode and waveform selection data;

FIG. 10 is a diagram showing a relationship between jetting modes and waveform selection data in a modified embodiment.

DETAILED DESCRIPTION OF THE PREFERRED EMBODIMENTS

An embodiment of the present invention will be described below. The embodiment described below is an example in which the present invention is applied to an ink-jet printer including an ink-jet head which jets droplets of ink onto a recording paper.

Figure 1:
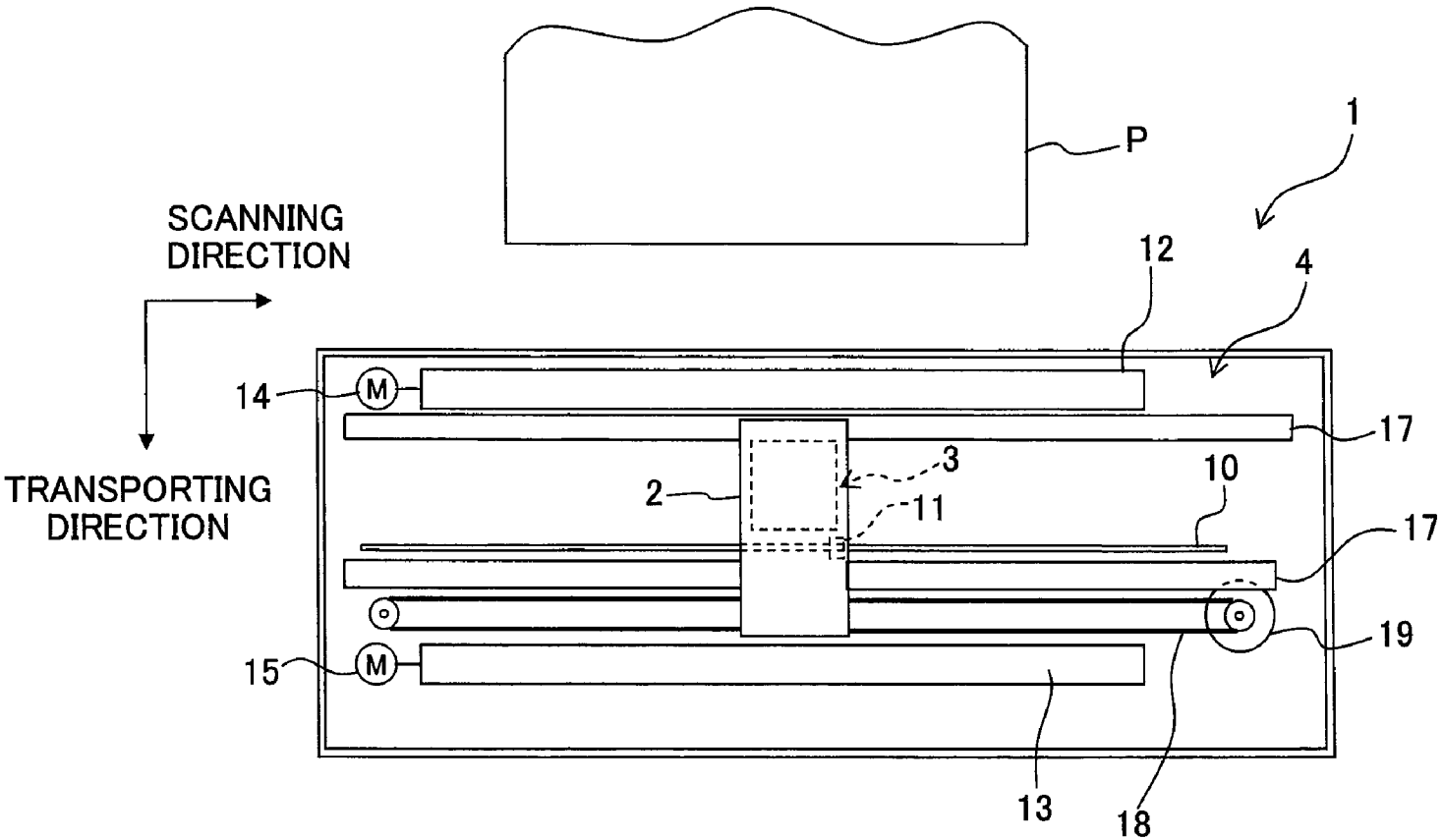
FIG. 1 is a schematic plan view of an ink-jet printer according to an embodiment of the present invention.

Firstly, a schematic structure of an ink-jet printer 1 (liquid droplet jetting apparatus) of the embodiment will be described below. As shown in FIG. 1, the ink-jet printer 1 includes a carriage 2 which reciprocates along a predetermined scanning direction (left-right direction in FIG. 1), an ink-jet head 3 which is attached to the carriage 2, and a transporting mechanism 4 which transports a recording paper P in a transporting direction which is orthogonal to the scanning direction.

The carriage 2 is reciprocatable along two guide shafts 17 extending in parallel to the scanning direction (left-right direction in FIG. 1). Moreover, an endless belt 18 is coupled with the carriage 2. When the endless belt 18 is driven and rotated by a carriage driving motor 19, the carriage 2 moves in the scanning direction together with the rotating of the endless belt 18. The ink-jet printer 1 is provided with a linear encoder 10 which has a large number of light transmission portions (slits) arranged in a row at an interval in the scanning direction. On the other hand, the carriage 2 is provided with a photosensor 11 of a transmission type having a light emitting element and a light receiving element. Moreover, the ink jet printer 1 identifies a current position in the scanning direction of the carriage 2 from a counted value (number of detections) of the light transmission portion of the linear encoder 10 detected by the photosensor 11 during the movement of the carriage 2.

The ink-jet head 3 is attached to the carriage 2. The ink-jet head 3 includes a plurality of nozzles 30 (refer to diagrams from FIG. 2 to FIG. 4) on a lower surface (surface on a rear side of a paper surface in FIG. 1) thereof. Ink supplied from an ink cartridge which is not shown in the diagram is jetted from the large number of nozzles 30 onto the recording paper P which is transported downward (transporting direction) in FIG. 1 by the transporting mechanism 4.

The transporting mechanism 4 includes a paper feeding roller 12 which is arranged at an upstream side in the transporting direction, of the ink-jet head 3, and a paper discharge roller 13 which is arranged at a downstream side, in the transporting direction, of the ink-jet head 3. The paper feeding roller 12 and the paper discharge roller 13 are rotated and driven by a paper feeding motor 14 and a paper discharge motor 15 respectively. Moreover, the transporting mechanism 4 transports the recording paper P to the ink-jet head 3 from an upper side in FIG. 1 by the paper feeding roller 12, and discharges the recording paper P having an image and characters etc. recorded thereon by the ink-jet head 3 to a lower side in FIG. 1 by the paper discharge roller 13.

Figure 2:
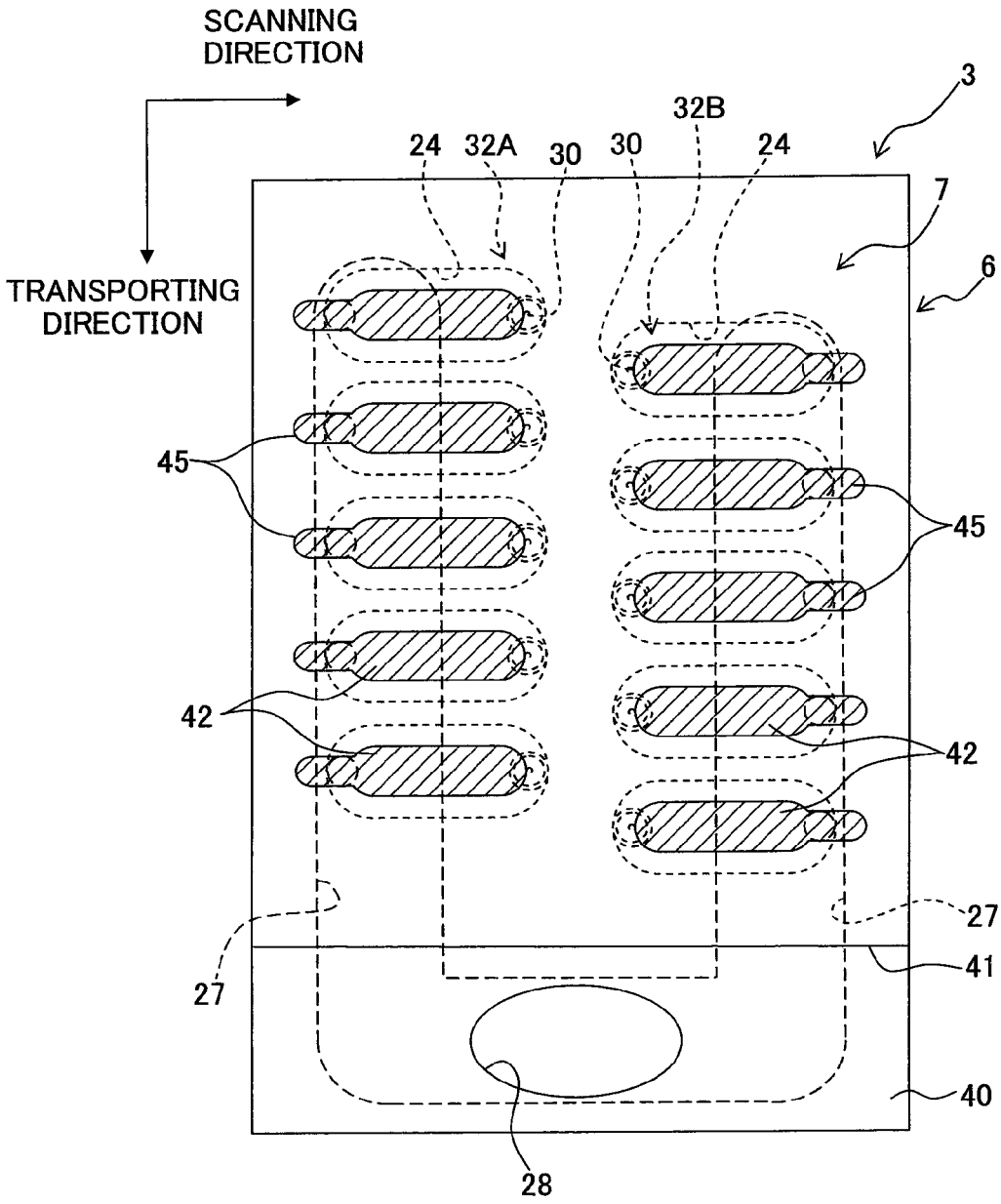
FIG. 2 is a plan view of the ink-jet head.
Figure 3:
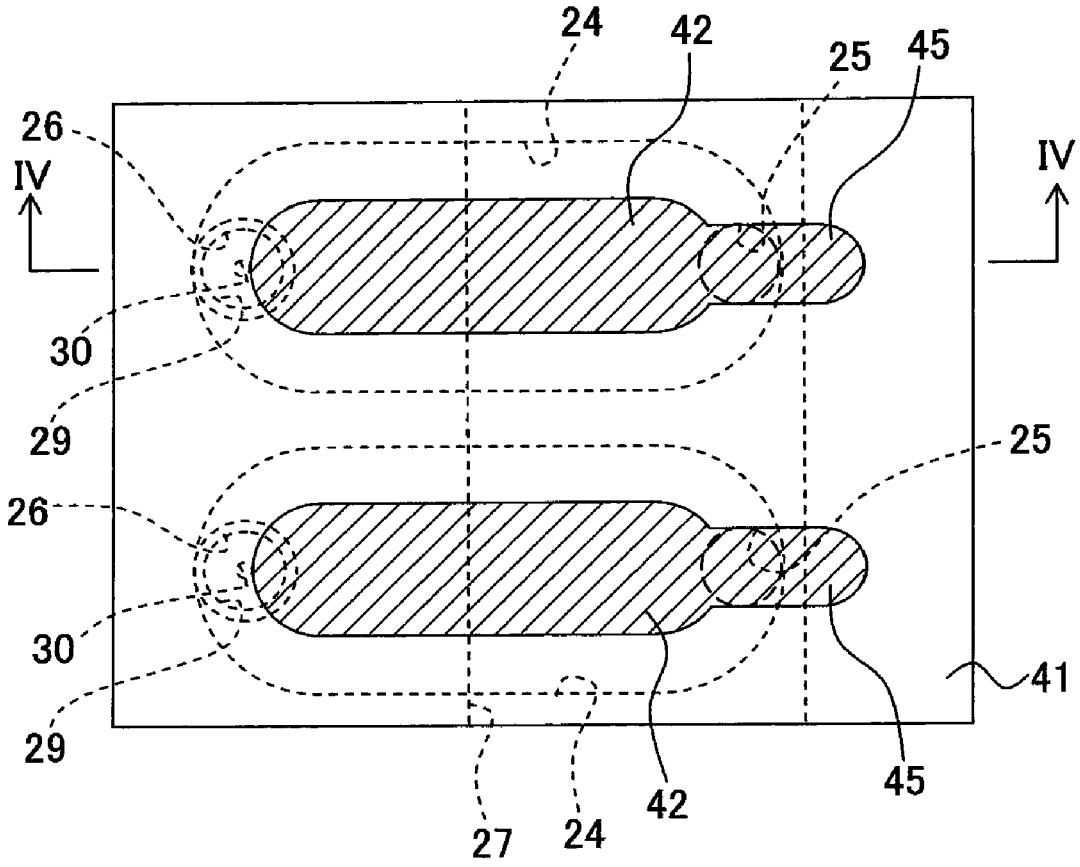
FIG. 3 is a partially enlarged view of FIG. 2.
Figure 4:
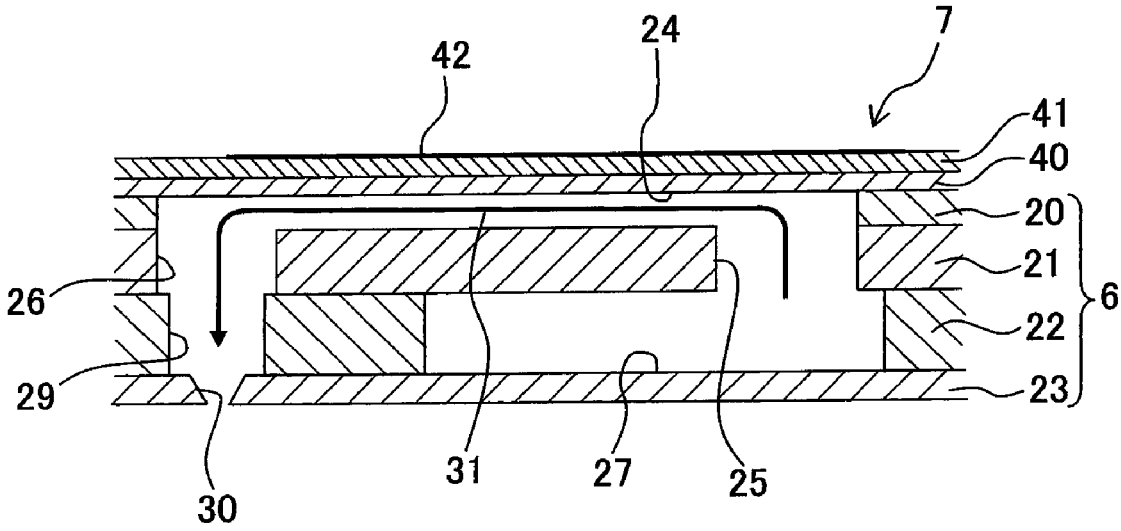
FIG. 4 is a cross-sectional view taken along a line IV-IV in FIG. 3.

Next, the ink-jet head 3 will be described below. As shown in FIG. 2 to FIG. 4, the ink-jet head 3 includes a channel unit 6 in which ink channels including the nozzles 30 and pressure chambers 24 are formed respectively, and an actuator unit 7 of a piezoelectric type which applies a pressure to the ink inside the pressure chambers 24.

Firstly, the channel unit 6 will be described below. As shown in FIG. 4, the channel unit 6 includes a cavity plate 20, a base plate 21, a manifold plate 22, and a nozzle plate 23, and these four plates are joined in a stacked form. Out of these four plates, each of the cavity plate 20, the base plate 21, and the manifold plate 22 is a substantially rectangular shaped plate in a plan view, made of a metallic material such as stainless steel. Therefore, it is possible to form the ink channels such as the pressure chambers 24 and manifolds 27 which will be described later easily by a method such as etching in these three plates. The nozzle plate 23 is formed of a high-molecular synthetic resin material such as polyimide, and is adhered to a lower surface of the manifold plate 22 by an adhesive. Or, the nozzle plate 23 may be formed of a metallic material such as stainless steel similarly as the three plates namely the cavity plate 20, the base plate 21, and the manifold plate 22.

As shown in FIG. 2 to FIG. 4, the pressure chambers 24 arranged in rows along a plane are formed by holes penetrating the cavity plate 20 which is arranged at top of the four plates namely the cavity plate 20, the base plate 21, the manifold plate 22, and the nozzle plate 23. Moreover, the plurality of pressure chambers 24 is arranged in two rows in a staggered form in the transporting direction (vertical direction in FIG. 2). As shown in FIG. 4, the pressure chambers 24 are covered by a vibration plate 40 which will be described later and the base plate 21, from an upper and a lower side respectively. Further, each of the pressure chambers 24 is formed to be substantially elliptical shaped which is longer in the scanning direction (left-right direction in FIG. 2) in a plan view.

As shown in FIG. 3 and FIG. 4, through holes 25 and 26 are formed in the base plate 21 at positions overlapping with both end portions of each of the pressure chambers 24 in the longitudinal direction in a plan view. Moreover, two manifolds 27 extending in the transporting direction are formed in the manifold plate 22 to overlap with a portion of each of the pressure chambers 24 arranged in two rows, on a side of the through hole 25, in a plan view. The two manifolds 27 communicate with an ink supply port 28 formed in the vibration plate 40 which will be described later, and an ink is supplied to the manifolds 27 from an ink tank not shown in the diagram, via the ink supply port 28. Further, a plurality of communicating holes 29 which communicate with the plurality of communicating holes 26 are formed in the manifold plate 22, at positions overlapping with end portions, of the pressure chambers 24 in a plan view, on an opposite side of the manifold 27.

The plurality of nozzles 30 are formed in the nozzle plate 23, at positions overlapping with the plurality of communicating holes 29 in a plan view. As shown in FIG. 2, the nozzles 30 are arranged to overlap with end portions, of the plurality of the pressure chambers 24 arranged in two rows along the transporting direction, on a side opposite to the manifold 27. In other words, the nozzles 30 are arranged in a staggered form forming two nozzle rows 32A and 32B arranged in the scanning direction, corresponding to the plurality of pressure chambers 24 arranged in the staggered form.

Moreover, as shown in FIG. 4, the manifolds 27 communicate with the pressure chambers 24 via the communicating holes 25, and further, the pressure chambers 24 communicate with the nozzles 30, respectively, via the communicating holes 26 and 29. In this manner, a plurality of individual ink channels 31 from the manifolds 27 up to the nozzles 30 via the pressure chambers 24 is formed in the channel unit 6.

In FIG. 2, for simplicity of the description, only one type of channel structure (the manifold 27, the pressure chambers 24, and the nozzles 30 etc.) communicating with one ink supply port 28 is described. However, the ink-jet head 3 may be a color ink-jet head having a structure in which a plurality of channel structures as shown in FIG. 2 is arranged in the scanning direction, and which is capable of jetting inks of a plurality of colors (for example, four colors namely, black, yellow, cyan, and magenta).

Next, the actuator unit 7 of the piezoelectric type will be described below. As shown in FIG. 2 to FIG. 4, the actuator unit 7 includes the vibration plate 40 which is arranged on an upper surface of the channel unit 6 (the cavity plate 20) to cover the plurality of pressure chambers 24, a piezoelectric layer 41 which is arranged on an upper surface of the vibration plate 40 to face the pressure chambers 24, and a plurality of individual electrodes 42 arranged on an upper surface of the piezoelectric layer 41.

The vibration plate 40 is a metal plate having a substantially rectangular shape in a plan view, and is made of an iron alloy such as stainless steel, a copper alloy, a nickel alloy, or a titanium alloy. The vibration plate 40 is joined to the cavity plate 20 in a form of being arranged, on the upper surface of the cavity plate 20, to cover the pressure chambers 24. Moreover, the upper surface of the vibration plate 40 which is electroconductive is arranged on a lower surface side of the piezoelectric layer 41, and also serves as a common electrode which generates an electric field in a thickness direction of the piezoelectric layer 41, between the plurality of individual electrodes 42 on the upper surface of the piezoelectric layer 41 and the common electrode. The vibration plate 40 as the common electrode is connected to a driver IC 47 (refer to FIG. 5) which drives the actuator unit 7, and which is kept at a ground electric potential all the time.

The piezoelectric layer 41 is made of a piezoelectric material which is principally composed of lead zirconium titanate (PZT). Lead zirconium titanate is a solid solution of lead titanate and lead zirconate, and is a ferroelectric substance. As shown in FIG. 2, the piezoelectric layer 41 is formed continuously on the upper surface of the vibration plate 40, to cover the plurality of pressure chambers 24. Moreover, the piezoelectric layer 41 is polarized, in a thickness direction, at areas facing at least the pressure chambers 24 respectively.

The plurality of individual electrodes 42 are arranged on the upper surface of the piezoelectric layer 41, at areas facing the plurality of pressure chambers 24 respectively. Each of the individual electrodes 42 has a substantially elliptical shape in a plan view which is slightly smaller than the pressure chamber 24, and is facing a central portion of one of the pressure chambers 24. Moreover, from end portions of the plurality of individual electrodes 42, a plurality of contact portions 45 is drawn along a longitudinal direction of the individual electrodes 42.

Figure 5:
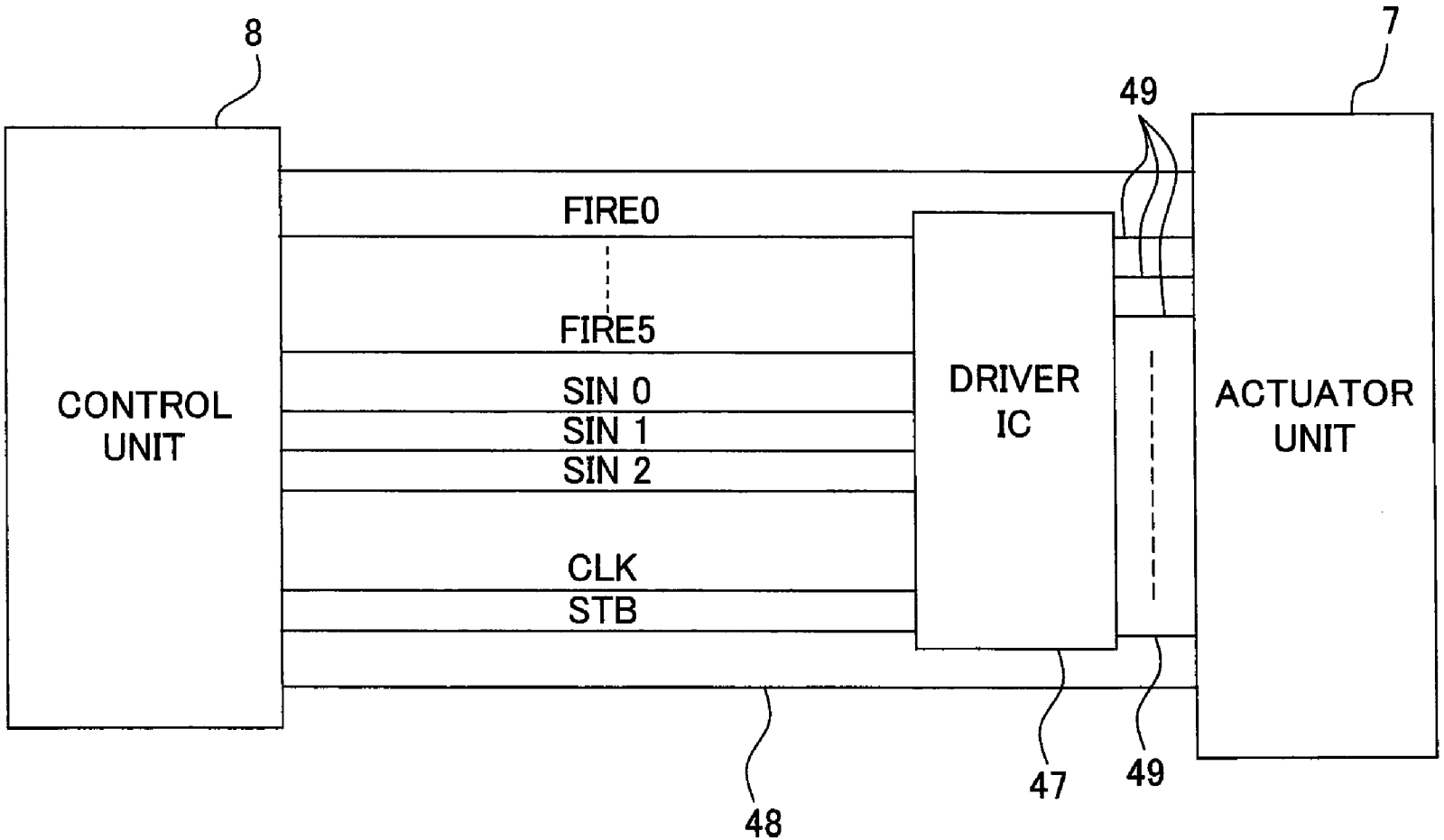
FIG. 5 is a diagram showing connections of an actuator unit, a driver IC, and a control unit.

As shown in FIG. 5, the plurality of contact portions 45 on the actuator unit 7 (the piezoelectric layer 41) are electrically connected to the driver IC 47 which is mounted on a flexible printed circuit (FPC) 48. Moreover, the driver IC 47 applies selectively, one of a predetermined driving electric potential and the ground electric potential to the plurality of individual electrodes 42, via the wirings on the FPC 48, based on a command from the control unit 8.

Next, an operation of the actuator unit 7 at the time of ink jetting will be described below. When a predetermined driving electric potential is applied to a certain individual electrode 42 from the driver IC 47, an electric potential difference is developed between the individual electrode 42 to which the driving electric potential is applied and the vibration plate 40 as the common electrode which is kept at the ground electric potential, and an electric field in the thickness direction is generated in the piezoelectric layer 41 sandwiched between the individual electrode 42 and the vibration plate 40. Since the direction of the generated electric field is parallel to the polarization direction of the piezoelectric layer 41, the piezoelectric layer 41 in an area facing the individual electrode 42 (active area) contracts in a planar direction orthogonal to the thickness direction. Here, since the vibration plate 40 on a lower side of the piezoelectric layer 41 is fixed to the cavity plate 20, with the contraction in the planar direction of the piezoelectric layer 41 positioned at the upper surface of the vibration plate 40, a portion of the vibration plate 40 covering one of the pressure chambers 24 is deformed to form a projection toward the pressure chamber 24 (unimorph deformation). At this time, since a volume inside the pressure chamber 24 decreases, a pressure on ink inside the pressure chamber 24 rises up, and the ink is jetted from the nozzle 30 communicating with this pressure chamber 24.

The ink-jet head 3, based on printing data which is inputted from a PC (personal computer) 59 (refer to FIG. 7) as a data input unit that will be described later, selects whether liquid droplets are to be jetted (jetting mode) or the liquid droplets are not to be jetted (non-jetting mode) at each jetting timing of each nozzle 30, and records (prints) desired characters and images by forming dots at predetermined positions on the recording paper P. The jetting timing of the nozzle 30 is a timing when the recording paper P transported in the transporting direction and the ink-jet head 3 which reciprocates in the scanning direction assumes a predetermined positional relationship, such that liquid droplets are landed on the recording paper P at predetermined positions to form dots. The jetting timing is determined based on a transporting speed of the recording paper P and a scanning speed of the carriage 2.

Further, for realizing high quality image printing by enabling a multi-gradation representation, for the nozzle 30 which jets the liquid droplets, one jetting mode is selected from among five types of jetting modes having mutually different volume of liquid droplets to be jetted (in other words, size of dots formed on the recording paper P). In other words, the ink-jet head 3 can selectively have one jetting mode from among six types of jetting modes related to liquid droplet jetting, including the non-jetting mode in which no liquid droplets are jetted, and five types of jetting modes having mutually different volume of liquid droplets.

Concretely, first of all, as shown in FIG. 5, data for associating one jetting mode from among the six types of jetting modes with each timing of each nozzle 30 (waveform selection data) is transferred from an ASIC (application specific integrated circuit) 54 (refer to FIG. 7) of the control unit 8 to the driver IC 47. The driver IC 47 generates a drive signal corresponding to the jetting mode which is associated with the data, and supplies to the plurality of contact portions 45 (individual electrodes 42) of the actuator unit 7.

As it has been mentioned earlier, out of the six types of jetting modes, in five types of jetting modes excluding the non-jetting mode, the volume of liquid droplets jetted in each jetting mode differs. Here, jetting amount of the liquid droplets (volume of liquid droplets) from the nozzle 30 is proportional to the pressure applied to the ink in the pressure chamber 24. Accordingly, the driver IC 47 supplies drive signals of plurality of types having different waveforms to the individual electrode 42 of the actuator unit 7 such that a pressure applied to the ink in the pressure chamber 24 is different. Accordingly, an electric potential of the individual electrode 42 is switched between a driving electric potential (V0) and the ground electric potential at an appropriate timing, and it is possible to jet selectively the liquid droplets of different sizes from the nozzles 30.

Figure 6:
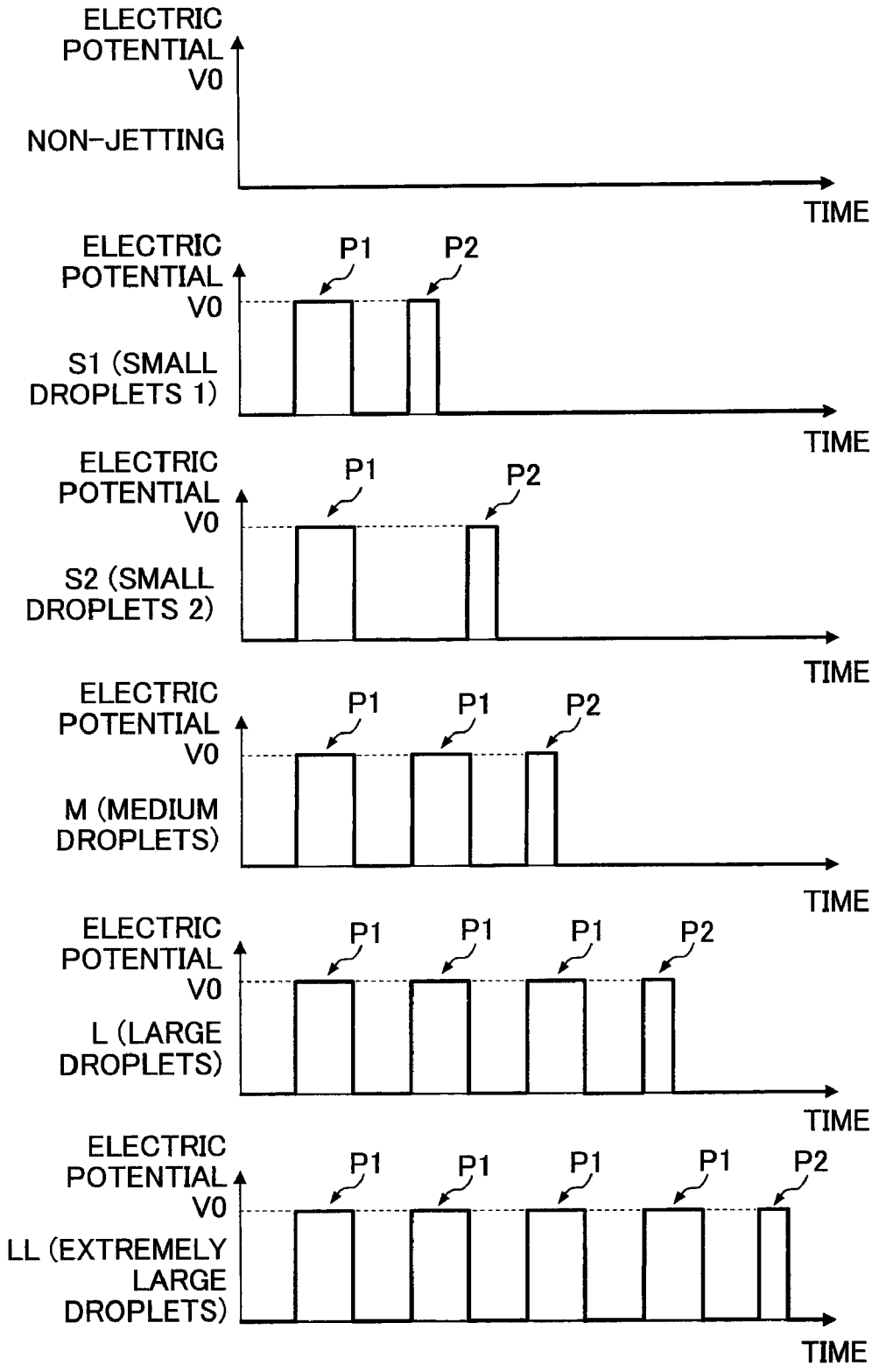
FIG. 6 is a diagram showing a pulse waveform of a drive signal which is applied by the driver IC to the actuator unit.

Pulse waveforms (hereinafter, called as "drive waveforms") of a jetting signal applied, from the driver IC 47, to the individual electrode 42 of the actuator unit 7 are shown in FIG. 6. In FIG. 6, six types of waveforms for non-jetting, S1 (small droplets 1), S2 (small droplets 2), M (medium droplets), L (large droplets), and LL (extremely large droplets) are indicated. The driver IC 47 applies one of these six types of drive signals to the individual electrode 42 of the actuator unit 7 corresponding to each nozzle 30. In the embodiment, the driving electric potential (V0) is configured to 3.3 V.

In FIG. 6, a drive signal corresponding to the mode in which the liquid droplets are not jetted (non-jetting) is a signal of a constant voltage (ground) which does not have a jetting pulse. Drive signals corresponding to S1 (small droplets 1) and S2 (small droplets 2) respectively include one jetting pulse P1 for jetting the liquid droplets, and one cancel pulse P2 for suppressing a fluctuation in ink pressure which is developed due to application of the jetting pulse P1. An interval between the jetting pulse P1 and the cancel pulse P2 in S1 is smaller than that in S2. Consequently, when a drive signal corresponding to S1 is applied to the individual electrode 42, it is possible to make the liquid droplets to be jetted from the nozzle 30 to be smaller than S2 by pulling back the liquid droplets to be jetted by the jetting pulse P1 halfway by the cancel pulse P2.

A drive signal for M (medium droplets) has a drive waveform in which one cancel pulse P2 is added after the two continuous jetting pulses P1. A drive signal for L (large droplets) has a drive waveform in which one cancel pulse P2 is added after three continuous jetting pulses P1. A drive signal for LL (extremely large droplets) has a drive waveform in which one cancel pulse P2 is added after four continuous jetting pulses P1. Moreover, the larger the number of the jetting pulses P1 applied continuously becomes, the higher pressure is applied to the ink, and large liquid droplets are jetted from the nozzle 30. In other words, for the jetting modes of five types (S1, S2, M, L, and LL), a size correlation of the liquid droplets is S1<S2<M<L<LL.

Next, an electrical structure of the ink-jet printer 1 will be described below by referring to block diagrams in FIG. 5 and FIG. 7. As shown in FIG. 5, the flexible printed circuit (FPC) 48 is connected to the control unit 8 of the ink jet printer 1. Moreover, the driver IC 47 of the ink-jet head 3 is mounted on the FPC 48. The control unit 8 and the driver IC 47, and the driver IC 47 and the actuator unit 7 are electrically connected via the large number of wires formed on the FPC 48.

Figure 7:
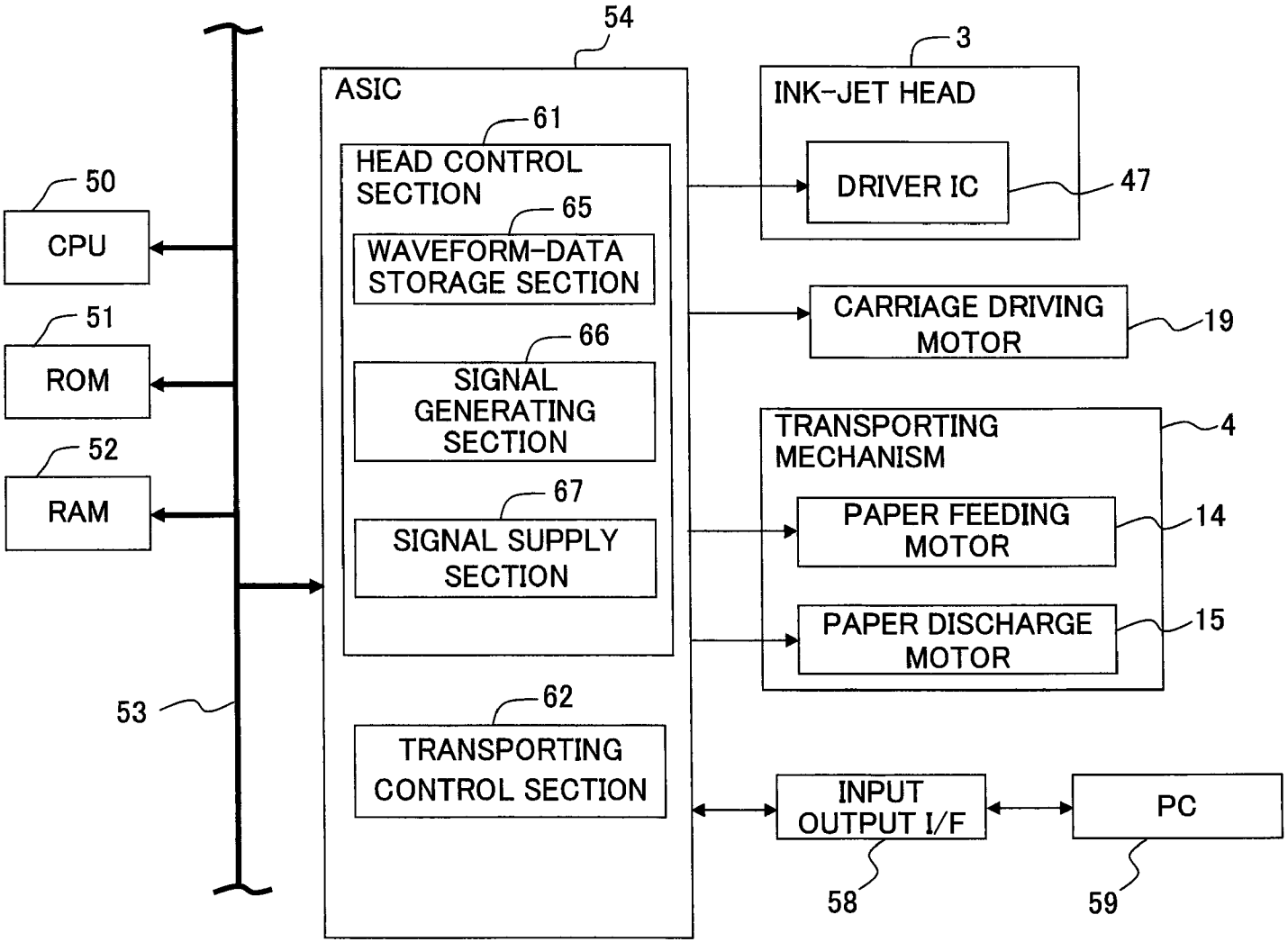
FIG. 7 is a block diagram schematically showing an electrical structure of a printer.

As shown in FIG. 7, the control unit 8 includes a CPU (central processing unit) 50, a ROM (read only memory) 51, a RAM (random access memory) 52, and a microcomputer having a bus 53 which connects the CPU 50, the ROM 51, and the RAM 52. The ASIC 54, which controls the driver IC 47 of the ink-jet head 3, the carriage driving motor 19 which drives the carriage 2, and the paper feeding motor 14 and the paper discharge motor 15 of the transporting mechanism 4, is connected to the bus 53. Moreover, for data communications, the ASIC 54 is connected to the PC 59 which is an external unit via an input-output interface (I/F) 58.

A head control section 61 (signal supply section), which controls the carriage driving motor 19 and the driver IC 47 of the ink-jet head 3 based on printing data inputted from the PC 59, and a transporting control section 62, which controls the paper feeding motor 14 and the paper discharge motor 15 of the transporting mechanism 4 based on the printing data are incorporated in the ASIC 54.

Next, the head control section 61 will be described below concretely. As shown in FIG. 7, the head control section 61 includes a waveform-data storage section 65, a signal generating section 66, and a signal supply section 67.

In the waveform-data storage section 65, data shown in FIG. 6 and related to driving waveforms of six types (waveform data) corresponding to the jetting modes of six types (the non-jetting mode, and the jetting modes of five types namely S1, S2, M, L, and LL) is stored.

The signal generating section 66 generates waveform selection signals (jetting signals) of six types for determining which one of the six types of waveform data is to be selected for each jetting timing of each nozzle. The waveform selection signals correspond to the waveform data of six types stored in the waveform-data storage section 65, respectively. Moreover, for distinguishing the jetting modes of six types, each of the waveform selection signals is formed by bit data of three digits (three bits).

Concretely, as shown in FIG. 8, waveform selection data corresponding to the non-jetting mode is denoted by "000", waveform selection data corresponding to S1 (small droplets 1) is denoted by "011", waveform selection data corresponding to S2 (small droplets 2) is denoted by "110", waveform selection data corresponding to M (medium droplets) is denoted by "100", waveform selection data corresponding to L (large droplets) is denoted by "001", and waveform selection data corresponding to LL (extremely large droplets) is denoted by "010". As it will be described later, a bit value of these waveform selection data is set such that the noise radiated from the wires of the FPC 48 is as small as possible, when the waveform selection data is serially inputted to the driver IC 47 from the ASIC 54 (more concretely, from the signal supply section 67 which will be described later).

The signal supply section 67 outputs waveform data of six types stored in the waveform-data storage section 65, and various signals including waveform selection data generated by the signal generating section 66 to the driver IC 47 via the wires (signal wires) of the FPC 48.

More elaborately, as shown in FIG. 5, the signal supply section 67 sends the waveform data of six types to the driver IC 47 by using six signal wires (FIRE 0 to FIRE 5). Moreover, the signal supply section 67 serially outputs waveform selection data (bit data of three digits: FIG. 8) selected for each jetting timing of each nozzle 30, upon synchronizing with a clock (CLK), to the driver IC 47 by using signal wires (SIN_0 to SIN_2). As described above, if the frequency of the clock is configured to no less than 10 MHz in order to increase the transfer speed of the waveform selection data, the influence of the radiated noise from the wires (SIN_0 to SIN_2) due to transferring of the waveform selection data becomes remarkable. Accordingly, it is desirable that the frequency of the clock is less than 10 MHz irrespective of the number of bits of the waveform selection data. Furthermore, the signal supply section 67 transmits a strobe control signal which controls an operation of the driver IC 47 to the driver IC 47 by using a signal wire (STB).

The driver IC 47, based on the waveform selection data which is serially outputted to each nozzle 30, selects one type of waveform data from among the waveform data of six types. Moreover, the driver IC 47 amplifies a signal and generates a drive signal (refer to FIG. 5), and supplies to the actuator unit 7 (more concretely, to the individual electrode 42 corresponding to each nozzle 30).

The signal supply section 67 serially outputs the waveform selection data corresponding to the large number of nozzles 30 respectively by three signal wires (SIN_0 to SIN_2). For instance, for simplicity of the description, when the ink jet head 3 has 300 nozzles 30, the waveform selection data for ⅓ of 300 nozzles 30, namely for 100 nozzles 30 is transferred by one signal wire. In other words, 100 waveform selection data (data of total 300 bits) at a certain jetting timing, corresponding to the 100 nozzles 30, are transmitted in order by one signal wire (SIN_x:x=0~2).

FIG. 9A to FIG. 9F are diagrams in which three waveform selection data (nine bit data) corresponding to three nozzles 30 (indicated by n−1, n, and n+1) in particular, from among the waveform selection data to be transferred serially and continuously, are arranged in order of transfer. Here, as it has been described earlier, when there is a large number of binary (0 or 1) switching between the bit data outputted continuously, the noise radiated from the wires (SIN_x:x=0~2) which transmit the waveform selection data becomes substantial to cause malfunction such as having an adverse effect on peripheral equipment. Consequently, it is preferable that the bit value of the waveform selection data of six types is set such that the number of switching of binary becomes as small as possible.

In general, there are differences in usage frequencies of the jetting modes (frequencies at which the jetting mode is selected) among the six types (the non-jetting mode and the jetting modes of five types: refer to FIG. 6) to which the waveform selection data of six types correspond respectively. Concretely, first of all, in a case of recording being carried out on the recording paper P by the ink jet printer 1, in many cases, a mode, in which a blank area on which the ink is not jetted is extremely large, as in a text printing is selected rather than a so-called daub printing, in which the ink is jetted over a wide area of the recording paper P as in a case of printing an image etc. In the text printing mode, for each nozzle 30, a frequency at which the jetting operation of liquid droplets is carried out becomes low. Therefore, out of the jetting modes of six types, the usage frequency of the non-jetting mode in which the ink is not jetted becomes the highest. Moreover, in the text printing, ratio of the area on which inks are jetted to the whole area of the recording paper P is approximately known, and small-size liquid droplets are frequently used so that the text recorded on the paper P can be recognized as the text. Therefore, among the jetting modes of five types, the frequency of use tends to be higher for jetting mode in which the volume of the liquid droplet is smaller. From the above-mentioned situation, when the jetting modes of six types are arranged in order of frequency of use, the relation becomes as follows. Non jetting>S1 (small droplets 1)>S2 (small droplets 2)>M (medium droplets)>L (large droplets)>LL (extremely large droplets).

Moreover, in a case in which there are differences in the usage frequencies of the jetting modes of six types as described above, when the jetting mode with a high usage frequency is selected in particular, it is desirable to make an arrangement such that the radiation noise is reduced. Therefore, in the embodiment, regarding the waveform selection data of six types corresponding to the jetting modes of six types respectively, the setting is such that when the waveform selection data corresponding to the jetting mode with high usage frequency is supplied to the driver IC 47, the number of the binary switching between the bit data becomes small.

Figure 9A:
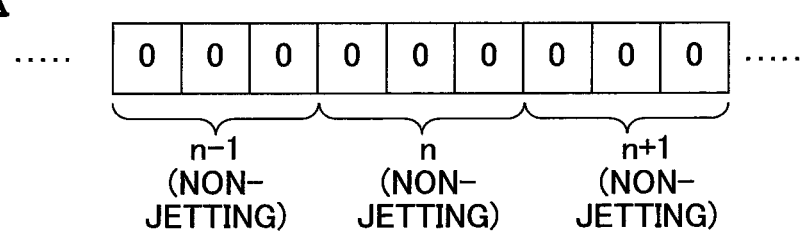
FIG. 9A, FIG. 9B, FIG. 9C, FIG. 9D, FIG. 9E, and FIG. 9F (hereinafter, "FIG. 9A to FIG. 9F") are diagrams in which three waveform selection data to be transferred serially are arranged in order of transfer.

The description will be made concretely by referring to FIG. 8 and FIG. 9. As shown in FIG. 8, for the waveform selection data (a first jetting signal) corresponding to the non-jetting mode with the highest frequency of use, "000" in which the value of the bit data of each digit is same ("0") is selected. Therefore, as shown in FIG. 9A, when the waveform selection data corresponding to the non-jetting mode is to be outputted continuously, since only bit data of bit value "0" is outputted continuously, there is no binary switching of the bit value at all.

As the waveform selection data corresponding to the non-jetting mode, "111" in which the value of the bit data for each digit is "1" may be adopted. However, in this case, when the non-jetting mode continues, since a signal having a high signal level (signal H) is supplied all the time to a signal wire, it may cause an increase in electric power consumption due to a leakage current. From this viewpoint, it is desirable that the waveform selection data corresponding to the non-jetting mode is "000".

Next, waveform selection data corresponding to S1 having a second highest frequency of use (second jetting signal) and a waveform selection data corresponding to S2 having a third highest frequency of use (third jetting signal) are set to "011" and "110" respectively.

In other words, for the waveform selection data corresponding to S1, a value of the most significant bit ("0") at third digit and a value of the least significant bit ("1") at first digit are different. Moreover, when this waveform selection data is outputted serially and independently (when only bit data of three bits forming this waveform selection data is serially outputted), binary switching occurs once (concretely, only one switching between "0" at third digit and "1" at second digit).

Moreover, in the waveform selection data corresponding to S2, a value of the most significant bit ("1") at third digit and a value of the least significant bit ("0") at first digit are different. Moreover, the most significant bit ("1") at third digit coincides with the least significant bit ("1") of the waveform selection data corresponding to S1. In other words, the waveform selection data corresponding to S2 and the waveform selection data corresponding to S1 have a value of the most significant bit and a value of the least significant bit opposite (reverse). Furthermore, similarly as S1, when this waveform selection data is outputted serially and independently, binary switching occurs once (only one switching between "1" at second digit and "0" at first digit).

Figure 9B:
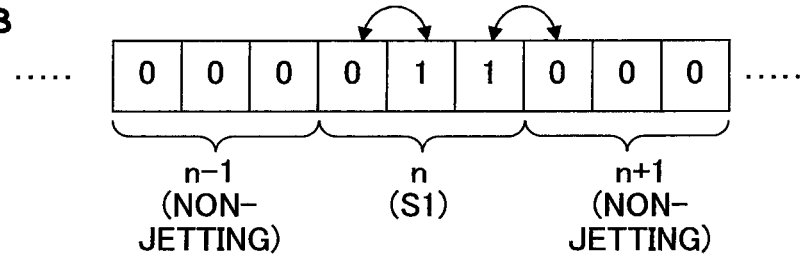
Figure 9C:
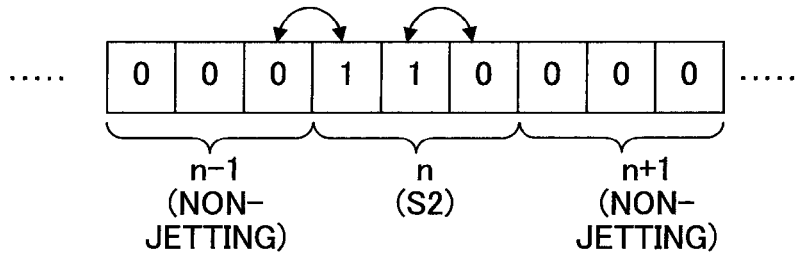
Figure 9D:
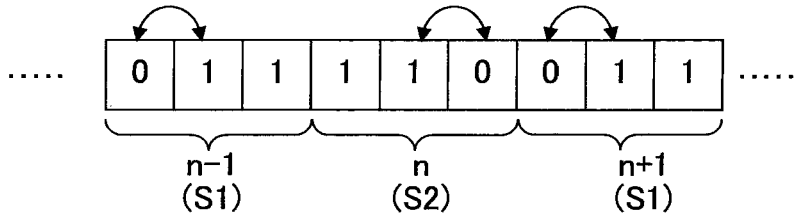

Therefore, as shown in FIG. 9B and FIG. 9C, when the waveform selection data corresponding to the non-jetting mode having the highest frequency of use is jetted before and after the waveform selection data corresponding to S1 or S2, the frequency of the binary switching while these three waveform selection data are outputted serially is suppressed only twice, namely, the binary switching (once) in the waveform selection data of S1 or S2, and the binary switching (once) between the waveform selection data corresponding to the non-jetting mode either before or after the waveform selection data of S1 or S2 and the waveform selection data of S1 or S2. Moreover, as shown in FIG. 9D, when the waveform selection data of S1 and the waveform selection data of S2 are outputted continuously, since the most significant bit and the least significant bit of both waveform selection data are opposite, the binary switching between the two waveform selection data does not occur. In other words, the binary switching occurring in the three waveform selection data is suppressed only to three times.

Figure 9E:
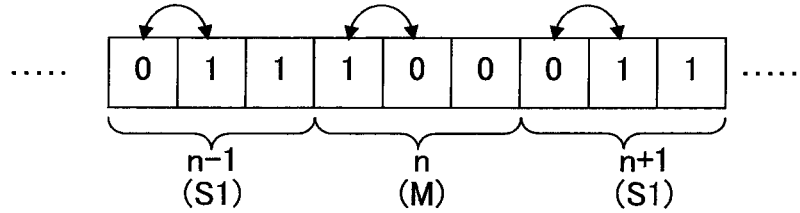

Moreover, as shown in FIG. 8, wavelength selection data corresponding to M having fourth highest usage frequency (fourth jetting signal) is set to "100" from a viewpoint similar to the waveform selection data corresponding to S2. In other words, for the waveform selection data corresponding to M, similarly as for the waveform selection data corresponding to S2, a value of the most significant bit ("1") at third digit and a value of the least significant bit ("0") at first digit are different. Moreover, for the waveform selection data corresponding to M and the waveform selection data corresponding to S1, a value of the most significant bit and a value of the least significant bit are opposite. Furthermore, similarly as for S1 and S2, when this selection data is output serially, the binary switching occurs once. By being set in such manner, as shown in FIG. 9E, when the waveform selection data of S1 and the waveform selection data for M are outputted continuously, the binary switching between the two waveform selection data does not occur.

Furthermore, even for wavelength selection data corresponding to L having fifth highest usage frequency, similarly as for S1, S2, and M, a value of the most significant bit and a value of the least significant bit are different, and is set to "001" such that the binary switching occurs once when this selection data is outputted serially.

In FIG. 8, for waveform selection data of four types of "011", "110", "100", and "001" associated with S1, S2, M, and L respectively, the values of the most significant bits and the values of the least significant bits are different respectively, and moreover, the binary switching occurs once when one of these selection data is outputted serially. Therefore, from a viewpoint of making less the frequency of the binary switching, any one of the four types of waveform selection data may be associated as the waveform selection data corresponding to S1 having the highest frequency of use in the jetting modes of four types. Moreover, after the waveform selection data of S1 is determined from the four types, the waveform selection data corresponding to remaining S2, M, and L may be determined based on the waveform selection data of S1 which is determined. For instance, when the waveform selection data corresponding to S1 is set to be "001", it is possible to determine S2 as "100", M as "110", and L as "011", based on S1.

However, when an external noise which is radiated from surrounding is mixed, bit data of the bit value "0" may be misdetected as bit data of "1" since the signal level becomes high. Therefore, for preventing this misdetection to a possible extent, in the waveform selection data corresponding to S1 and S2 having a high frequency of use, it is favorable that bit data having bit value "0" is less. In other words, it is favorable that waveform selection data for which digits with a bit value 1 are largest in number, or in other words, "011" and "110", are selected from among the waveform selection data of four types.

Figure 9F:
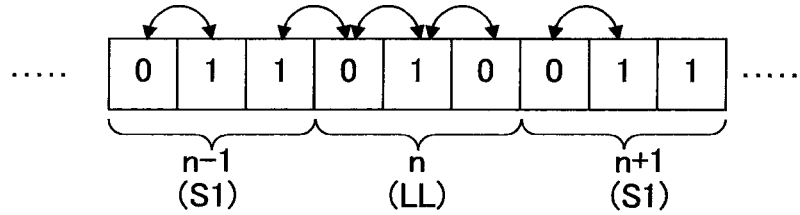

On the other hand, coming back to FIG. 8, waveform selection data corresponding to LL (extremely large droplets) having the lowest usage frequency is set to "010". For this waveform selection data, firstly, the binary switching occurs twice when the waveform selection data is outputted serially. Furthermore, as shown in FIG. 9F, when the waveform selection data of S1 having the highest usage frequency is outputted before and after this waveform selection data of LL, the binary switching occurs even between the waveform selection data of LL and the waveform selection data of S1, and the binary switching occurs five times while the three waveform selection data are outputted.

It is also possible to set "101" rather than "010", as the waveform selection data corresponding to LL. However, when output continuously with the waveform selection data corresponding to the non-jetting (mode) having the highest frequency of use, in order that the binary switching between the non-jetting and the waveform selection data of LL does not occur, when the waveform selection data corresponding to non-jetting is "000", it is preferable to let the waveform selection data corresponding to LL to be "010".

As it has been described above, in the embodiment, the signal (any one of "011", "110", "100", and "001") in which the value of the most significant bit and the value of the least significant bit are different, and in which the binary switching occurs once when serially outputted is selected as the waveform selection data corresponding to S1 having the highest usage frequency. On the other hand, the signal ("010" or "101"), in other words, the signal in which the value of the most significant bit and the value of the least significant bit are same, and in which the binary switching occurs twice is when serially outputted. Accordingly, when the waveform selection data are outputted serially and continuously, more the waveform selection data corresponding to the jetting modes with higher usage frequencies are included, the frequency of binary switching becomes less.

Next, a modified embodiment in which various modifications are made in the embodiment will be described below. Same reference numerals are assigned to components having a structure similar as in the embodiment, and description of such components is omitted appropriately.

In the above described embodiment, the ink-jet head is mainly used for text printing in which the non-jetting mode is used most frequently, and among the other jetting modes, smaller the volume of the liquid droplets which are jetted, the usage frequency becomes higher. However, the usage frequency of the jetting mode changes according to an application of an ink-jet head. For example, in a case in which the ink-jet head is used for an application of printing mainly images, since inks are jetted on almost all area of the recording paper, the usage frequency of the non-jetting mode is the lowest among the six types of jetting modes. In a case of printing a rough image, a frequency of jetting liquid droplets of a large volume becomes high. Accordingly, the six types of jetting modes are arranged in decreasing order of the usage frequencies as follows. LL (extremely large droplets)>L (large droplets)>M (medium droplets)>S2 (small droplets 2)>S1 (small droplets 1)>Non-jetting. Thus the waveform selection data corresponding to the jetting modes may be set such that larger the volume of the liquid droplets jetted in the jetting modes, the frequency of the binary switching decreases. Concretely, the waveform selection data corresponding to LL, L, M, S2, S1, and Non-jetting may be set to be "000", "011", "110", "100", "001" and "010", respectively, in this order. In a case of printing a fine image, a frequency of jetting liquid droplets of a small volume becomes high. Accordingly, the six types of jetting modes are arranged in decreasing order of the usage frequencies as follows. S1 (small droplets 1)>S2 (small droplets 2)>M (medium droplets)>L (large droplets)>LL (extremely large droplets)>Non-jetting. Thus the waveform selection data corresponding to the jetting modes may be set such that smaller the volume of the liquid droplets jetted in the jetting modes, the frequency of the binary switching decreases. Concretely, the waveform selection data corresponding to S1, S2, M, L, LL, and Non-jetting may be set to be "000", "011", "110", "100", "001" and "010", respectively, in this order.

Moreover, the jetting modes of the plurality of types of the present invention are not restricted to modes of jetting liquid droplets of different volumes. For instance, when it is possible to jet selectively liquids of different types from each nozzle, it is possible to let the jetting mode of plurality of types to be modes of jetting liquids of various types having different usage frequencies.

In the embodiment, the waveform selection data of plurality of types corresponding to the jetting modes of plurality of types respectively has been formed of bit data of three bits. However, the number of digits (the number of bits) of the waveform selection data is not restricted to three bits.

For instance, the present invention is also applicable to a case in which the waveform selection data is formed of bit data of four digits. As shown in FIG. 10, in a case of having jetting modes of six types (No. 1 to No. 6) having different frequency of use, for each nozzle, waveform selection data corresponding to jetting mode having the highest frequency of use (No. 1) is set to "0000" in which all bit values are same. Moreover, waveform selection data corresponding to a jetting mode having the second highest frequency of use (No. 2) is set to "0111" in which a value of the most significant bit and a value of the least significant bit are different, and in which the binary switching occurs once.

Moreover, waveform selection data corresponding to jetting modes having third highest frequency of use, fourth highest frequency of use, and fifth highest frequency of use (No. 3 to No. 5), are set to "1000", "1100", and "1110" respectively, in which a value of the most significant bit and a value of the least significant bit are opposite (reverse) of the values for No. 2, and in which the binary switching occurs once. Furthermore, waveform selection data corresponding to a jetting mode having the lowest frequency of use (No. 6) is set to "0110" in which the binary switching occurs twice.

Accordingly, first of all, when the waveform data of No. 1 having the highest frequency of use is outputted continuously, the binary switching does not occur. Moreover, for the waveform selection data of jetting modes from No. 2 to No. 5, the binary switching occurs only once. Furthermore, when the waveform selection data of the jetting mode No. 2 having the second highest frequency of use, and a waveform selection data corresponding to any one of the jetting modes from No. 3 to No. 5 are outputted continuously, the binary switching does not occur between the two waveform selection data.

Whereas, in the waveform selection data of the jetting mode no. 6 having the lowest frequency of use, the binary switching occurs twice. Furthermore, when the waveform selection data of the jetting mode No. 2 having the second highest frequency of use is outputted before No. 6, the binary switching occurs between the two waveform selection data.

In other words, by the waveform selection data of six types corresponding to the jetting modes of six types being set as in FIG. 10, higher the frequency of use for the waveform selection data which is outputted serially, the binary switching occurs less.

What is claimed is:

1. A liquid droplet jetting apparatus which jets liquid droplets, comprising:

a nozzle which jets the liquid droplets in a plurality of types of jetting modes;

a liquid droplet jetting head which includes the nozzle;

a signal generating section which generates a plurality of types of jetting signals, where each jetting signal;

is formed of bit data;

has predetermined bits not less than three bits; and corresponds to one of the plurality of types of jetting modes; and a signal supply section which serially outputs the bit data forming one of the jetting signals to the liquid droplet jetting head at each of jetting timings of the nozzle;

wherein the jetting signals are set such that the jetting signals corresponding to the jetting modes respectively are subjected to binary switching of the bit data at frequencies decreasing proportional to usage frequencies of the jetting modes when the bit data are outputted serially from the signal supply section to the liquid droplet jetting head;

wherein the plurality of types of jetting signals includes:

a first jetting signal corresponding to a jetting mode having the highest usage frequency among the jetting modes;

a second jetting signal corresponding to a jetting mode having a second highest usage frequency among the jetting modes; and a third jetting signal corresponding to a jetting mode having a third highest usage frequency among the jetting modes;

wherein, in the first jetting signal, each bit of the bit data has a same value;

wherein, in the second jetting signal, a value of a first serially transmitted bit and a value of a last serially transmitted bit are different, and the binary switching occurs only once when the bit data of the second jetting signal is outputted serially; and wherein, in the third jetting signal, a value of a first serially transmitted bit and a value of a last serially transmitted bit are different, the binary switching occurs only once when the bit data of the third jetting signal is outputted serially, and the value of the first serially transmitted bit coincides with the value of the last serially transmitted bit of the second jetting signal.

2. The liquid droplet jetting apparatus according to claim 1;

wherein the plurality of types of jetting signals includes a fourth jetting signal corresponding to a jetting mode having a fourth highest usage frequency among the jetting modes; and wherein, in the fourth jetting signal, a value of a first serially transmitted bit and a value of a last serially transmitted bit are different, the binary switching occurs only once when the bit data of the fourth jetting signal is outputted serially, and the value of the first serially transmitted bit coincides with the value of the last serially transmitted bit of the second jetting signal.

3. The liquid droplet jetting apparatus according to claim 1: wherein the second jetting signal and the third jetting signal each have the same number of bits with a value of 1, where the second jetting signal and the third jetting signal have more bit with a value of 1 than the other jetting signals.

4. The liquid droplet jetting apparatus according to claim 1: wherein the plurality of types of jetting modes includes a non-jetting mode in which liquid droplets are not jetted; wherein the first jetting signal corresponds to the non-jetting mode; wherein the second jetting signal corresponds to a jetting mode in which liquid droplets of the smallest volume among the droplets of the jetting modes are jetted; and wherein the third jetting signal corresponds to a jetting mode in which liquid droplets of a second smallest volume among the droplets of the jetting modes are jetted.

5. The liquid droplet jetting apparatus according to claim 1: wherein a value of each bit is 0 in the first jetting signal.

6. The liquid droplet jetting apparatus according to claim 1: wherein the signal supply section outputs a clock, with which the jetting signal is synchronized, to the liquid droplet jetting head, where a frequency of the clock is less than 10 MHz.

* * * * *